US006974613B2

(12) United States Patent
Sellmeier et al.

(10) Patent No.: US 6,974,613 B2
(45) Date of Patent: Dec. 13, 2005

(54) PACKAGING FOR PLASTICS ADDITIVES

(75) Inventors: Helmut Sellmeier, Lengerich (DE); Uwe Wiegand, Hörstel (DE)

(73) Assignee: Bischof + Klein GmbH & Co. KG, Lengerich (DE)

( * ) Notice: Subject to any disclaimer, the term of this patent is extended or adjusted under 35 U.S.C. 154(b) by 13 days.

(21) Appl. No.: 10/248,524

(22) Filed: Jan. 27, 2003

(65) Prior Publication Data

US 2004/0048017 A1 Mar. 11, 2004

(30) Foreign Application Priority Data

Sep. 6, 2002 (DE) ..... 202 13 779 U

(51) Int. Cl.[7] ..... B32B 1/02
(52) U.S. Cl. ..... 428/35.7; 428/349; 428/913
(58) Field of Search ..... 428/35.7, 36.9, 428/349, 913

(56) References Cited

U.S. PATENT DOCUMENTS 4,453,997 A * 6/1984 Hori et al. ..... 156/305
5,257,491 A * 11/1993 Rouyer et al. ..... 53/428
5,413,412 A * 5/1995 Odabashian ..... 383/208
5,789,048 A * 8/1998 Flieger ..... 428/36.92

FOREIGN PATENT DOCUMENTS

DE 4205919 A1 * 9/1993 ..... B65B/9/00

* cited by examiner

*Primary Examiner*—Sandra Nolan Rayford

(57) ABSTRACT

A packaging for an additive to be added to a plastic batch consists of a packaging film of thermomelting plastic material shaped to form a bag and a thermomelting polyolefin-based adhesive applied to the plastic film and forming closure seams for sealing the bag. The adhesive is moisture crosslinking and can be a hot melt. The thermomelting plastic material is identical to or compatible with a plastic material of the plastic batch to which the packaging and the additive are to be added.

7 Claims, 1 Drawing Sheet

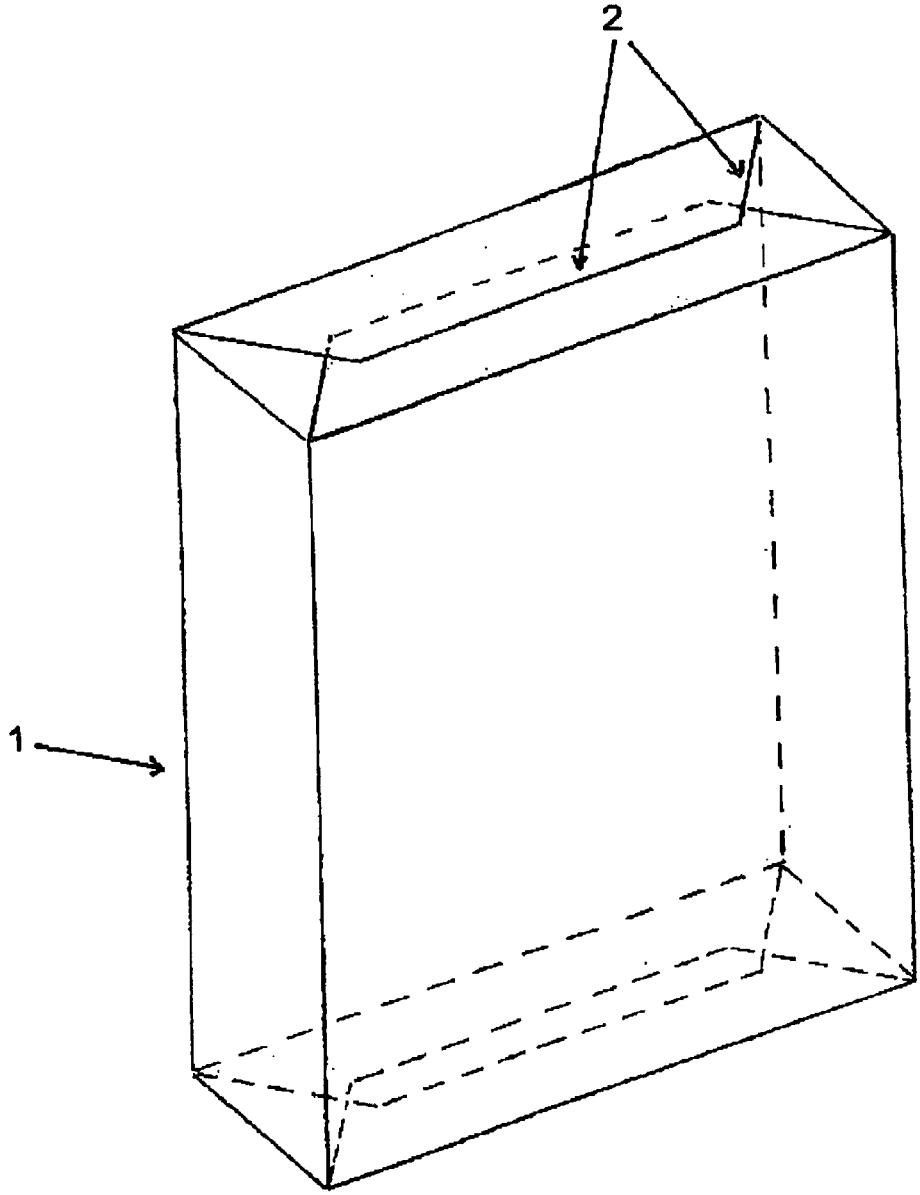
2
1

PACKAGING FOR PLASTICS ADDITIVES

BACKGROUND OF INVENTION

The invention relates to a packaging made of plastic film in the shape of a sack or bag for plastics additives, for example, pigments, to be added to a batch of plastic material.

SUMMARY OF INVENTION

It is an object of the present invention to provide a packaging of the aforementioned kind for receiving a predetermined quantity of an additive, for example, a pigment, which packaging is completely thermodissolving, can be added together with its contents to a plastic batch without requiring the packaging to be opened, and can become in its entirety a component of this plastic batch.

In accordance with the present invention, this is achieved in that the film of the packaging is comprised of thermomelting plastic material and in that, for forming the seams of the packaging, a thermomelting adhesive on the basis of polyolefin is provided.

Preferably, the adhesive is of the moisture cross-linking type. The adhesive can be a hot melt.

The adhesive has preferably a density of approximately 0.87 to 0.91 g/cm$^3$.

Preferably, the adhesive has a melt viscosity of approximately 15,000 to 20,000 Pas.

Preferably, the adhesive has an open bonding time of approximately 120 seconds.

The thermomelting plastic film of the packaging is made of a plastic material which is identical to or compatible with the plastic material of the plastic batch to which it is to be added.

The packaging according to the invention ensures that the packaging film as well as the closure seams of the packaging are completely meltable. Accordingly, the packaging with its contents (the quantity of the contents is matched to the plastic batch to be processed) can be added during processing of the plastic batch in its entirety; the packaging with its contents is entirely absorbed in the plastic batch without any detrimental effects. The inventive packaging avoids waste as well as an opening and emptying process of the bag or sack when the additive is to be added; such opening and emptying processes usually cause significant soiling and pollution of the surroundings.

The bags or sacks can be of any known suitable configuration. The packaging can be of the pillow type or of a parallelepipedal shape. The closure seams for closing and sealing the bag can be simple transverse seams as well as shaping seams for creating shaped bottoms such as a cross bottom or block bottom. It is important in this connection that, after filling and closing of the packaging, the contents of the packaging is reliably sealed off relative to the environment and cannot escape to the exterior; likewise, no moisture can penetrate and alter or damagecontents of the packaging.

BRIEF DESCRIPTION OF DRAWINGS

The only FIGURE is a schematic illustration of a packaging in the form of a block bottom bag of a parallelepipedal shape.

DETAILED DESCRIPTION

The polyolefin adhesive for producing the closure seams of the packaging is preferably a hot melt which is moisture crosslinking. Advantageously, it has a density of approximately 0.87 to 0.91 g/cm$^3$. The preferred melt viscosity of the adhesive is approximately 15,000 to 20,000 Pas. Moreover, the adhesive advantageously has an open bonding time of 120 seconds so that sufficient time is available for applying the adhesive and carrying out the subsequent processing steps, for example, folding of the lateral bottom flaps, application of a bottom cover sheet, or the like, in order to produce the closure seams for sealing the bag/sack before filling the packaging as well as after filling.

The thermomelting plastic material is advantageously a plastic material which is identical to the plastic material of the plastic batch receiving the additive. At the least, the plastic material of the film for the packaging should be compatible with the plastic batch. Primarily, polyethylene is used as the plastic film for producing the packaging because it provides a high degree of compatibility and can be melted without leaving any residue.

The only FIGURE shows a block bottom bag 1 of a parallelepipedal shape as an example of a packing of the invention. The location of the closure seams 2 produced with the adhesive is only schematically indicated at the edges of the packaging film where the block bottoms are formed. Many different types of bags or sacks with glued closure seams are known in the packaging industry, and the inventive concept can be easily applied by a person skilled in the art to such packagings.

While specific embodiments of the invention have been shown and described in detail to illustrate the inventive principles, it will be understood that the invention may be embodied otherwise without departing from such principles.

What is claimed is:

1. A packaging for an additive to be added to a plastic batch, the packaging comprising:

a packaging film of thermomelting plastic material shaped to form a bag;

a thermomelting polyolefin-based adhesive applied to the plastic film and forming closure seams for sealing the bag, wherein the adhesive is moisture crosslinking.

2. The packaging according to claim 1, wherein the adhesive is a hot melt.

3. The packaging according to claim 1, wherein the adhesive has a density of approximately 0.87 to 0.91 g/cm$^3$.

4. The packaging according to claim 1, wherein the adhesive has a melt viscosity of approximately 15,000 to 20,000 Pas.

5. The packaging according to claim 1, wherein the adhesive provides a binding time of approximately 120 seconds.

6. The packaging according to claim 1, wherein the thermomelting plastic material is identical to a plastic material of the plastic batch to which the packaging and the additive are to be added.

7. The packaging according to claim 1, wherein the thermomelting plastic material is compatible with a plastic material of the plastic batch to which the packaging and the additive are to be added.

* * * * *